US005935090A

United States Patent [19]

Kennon

[11] Patent Number: 5,935,090

[45] Date of Patent: Aug. 10, 1999

[54] DEVICE FOR TREATING MUSCULAR AILMENTS

[76] Inventor: Joseph L. Kennon, 10210 NW. 57th Ter., Kansas City, Mo. 64152

[21] Appl. No.: 08/658,803

[22] Filed: Jun. 7, 1996

[51] Int. Cl.[6] ..... A61H 7/00

[52] U.S. Cl. ..... 601/134; 601/135; 601/136; 601/137; 601/118

[58] Field of Search ..... 601/118, 119, 601/129, 134, 135, 136, 137; 606/204

[56] References Cited

U.S. PATENT DOCUMENTS

| | | | |
|---|---|---|---|
| 1,185,583 | 5/1916 | Bond | 601/118 |
| 1,265,083 | 5/1918 | Hoard | 601/118 |
| 1,533,528 | 4/1925 | Weaver | 601/118 |
| 4,452,237 | 6/1984 | Lewis | 601/134 |
| 4,493,315 | 1/1985 | Iwahashi | 601/133 |
| 4,944,747 | 7/1990 | Newth et al. | 601/135 |
| 5,199,936 | 4/1993 | Moye | 482/126 |
| 5,405,311 | 4/1995 | Pecora et al. | 601/135 |

FOREIGN PATENT DOCUMENTS

| | | | |
|---|---|---|---|
| 4205052 | 8/1992 | Germany | 601/134 |
| 91/15180 | 10/1991 | WIPO | 601/134 |

*Primary Examiner*—Robert A. Hafer
*Assistant Examiner*—Benjamin Koo
*Attorney, Agent, or Firm*—Shook, Hardy & Bacon L.L.P.

[57] ABSTRACT

According to one aspect of the invention, a device is provided for treating muscular ailments. The device has a generally U-shaped frame. The frame has an elongated cross-member with a handle extending perpendicularly outwardly from each of two terminal ends of the cross-member. The device has a protrusion extending perpendicularly outwardly from the cross-member in the same direction as the handles. The protrusion can be either of a rectangular block or a roller and can be positionable along the longitudinal axis of the cross-member. In another aspect of the invention, a method is provided for using a device with a U-shaped frame and a protrusion to self-administer treatment for muscular and spinal ailments. The method involves locating a body part needing treatment and positioning the protrusion directly over the body part. Pressure is then applied to the body part by the protrusion. Additional pressure may be applied if necessary by using the handles and the cross-member of the device as levers. The protrusion is then repositioned a short distance away from the original position and pressure is reapplied.

10 Claims, 1 Drawing Sheet

DEVICE FOR TREATING MUSCULAR AILMENTS

BACKGROUND OF THE INVENTION

The present invention relates to devices for administering a massage or deep tissue treatment, and more specifically to devices which can be used to self-administer such a treatment.

People experience back pain and other types of muscular pain for a variety of reasons. For example, bodily pain and discomfort can be caused by heavy lifting and over-exertion. Further, lower back pain can result when a person's legs are of differing lengths. A number of treatments are available for combating this pain and discomfort. Medicines, such as pain relievers and muscle relaxants, are available over-the-counter and can be used to relieve the pain and relax the muscles for short periods of time. The major drawback in using these medications is that they last for such a short period of time. Should the pain reoccur or persist, more medication must be purchased and used. Continued use of these medicines can also become quite costly. Therefore, the medications currently available without a prescription often do not have a lasting effect and can be relatively expensive.

Another method for treating deep tissue and muscular discomfort is deep muscular massage. This technique of treating muscular discomfort aids in the relief of bodily and emotional tension. The effects of this method of treatment are also relatively short-term. Further, this method has the additional drawback of requiring an additional person. In other words, the person suffering from the muscular discomfort must seek out the services of one capable of providing such a deep muscular massage. Therefore, this method involves scheduling a treatment during a time period in which the provider is available. This availability is usually limited to normal business hours, and thus can require the person needing treatment to seek time away from work. It is therefore often difficult to schedule a treatment during hours which are convenient for the person experiencing the discomfort. Still further, this method can also become quite expensive. Because the effects of this treatment are short-lived, a series of repeat visits is often necessary. The need for repeat visits further increases the costs associated with this method of treatment.

Finally, the person experiencing the discomfort may seek out the services of a chiropractor. Chiropractors generally utilize a system of therapy in which disease or discomfort is considered the result of an abnormal function of the nervous system. Treatment by a chiropractor usually involves the manipulation of the spinal column and other bodily structures. As with the methods described above, while chiropractic treatment does relieve the pain and discomfort, the relief provided is often temporary. Further, chiropractic visits can become expensive, especially if a lengthy course of treatments is needed. Still further, as with deep tissue massage, the person experiencing discomfort must schedule a chiropractic treatment during hours in which the chiropractor is available, which can be inconvenient for the person experiencing discomfort.

Therefore, a method and a device for treating muscular ailments is needed which will allow a person to self-administer a treatment that alleviates pain and discomfort. Further, such a device is needed that can provide relatively inexpensive relief from the pain and discomfort. Still further, a device is needed that provides relief from muscular ailments without the need for medications.

SUMMARY OF THE INVENTION

It is an object of the present invention to provide a device which can be used to self administer deep massage therapy to a variety of locations on the body, including the back.

It is another object of this invention to provide a device which can be used to self-correct ailments associated with a difference in leg length.

A further object of this invention is to provide a device that enables a user to apply a greater amount of force to the affected region than would be possible utilizing only the hands of the user.

It is still another object of this invention to provide a device which can selectively provide a self-administered treatment at a specific location on the body or which can provide a deep rolling treatment along a greater part of the body.

It is yet another object of this invention to provide a method of using a device to self-administer a deep muscular massage to a variety of locations, including the back, and which allows a user to apply a greater amount of force than is possible utilizing only the user's hands.

According to one aspect of the present invention, the foregoing and other objects are obtained by a device that has a generally U-shaped frame. The U-shaped frame has a pair of handles that are located at opposite terminal ends of an elongated cross-member. The handles extend perpendicularly outward from the cross-member. Extending perpendicularly outward in the same direction as the handles is a protrusion located between the handles on the cross-member. The protrusion can be either of a rectangular block or a roller. The protrusion may be movable along the longitudinal axis of the cross-member.

In accordance with another aspect of the invention, the above-described device is used according to a method where the device is held by a person desiring treatment, and pressure is applied to the desired area by the protrusion. Additional force is applied to the desired area by using the handles and the cross-member as levers. The protrusion is then moved a short-distance from the original area and the above process is repeated.

Additional objects, advantages and novel features of the invention will be set forth in part in the description which follows, and in part will become apparent to those skilled in the art upon examination of the following, or may be learned from practice of the invention. The objects and advantages of the invention may be realized and attained by means of the instrumentalities and combinations particularly pointed out in the appended claims.

BRIEF DESCRIPTION OF THE DRAWINGS

In the accompanying drawings which form a part of the specification and which are to be read in conjunction therewith and in which like reference numerals are used to indicate like parts in the various views.

DETAILED DESCRIPTION OF THE PREFERRED EMBODIMENTS

Figures 1, 2, 3, 4, 5:
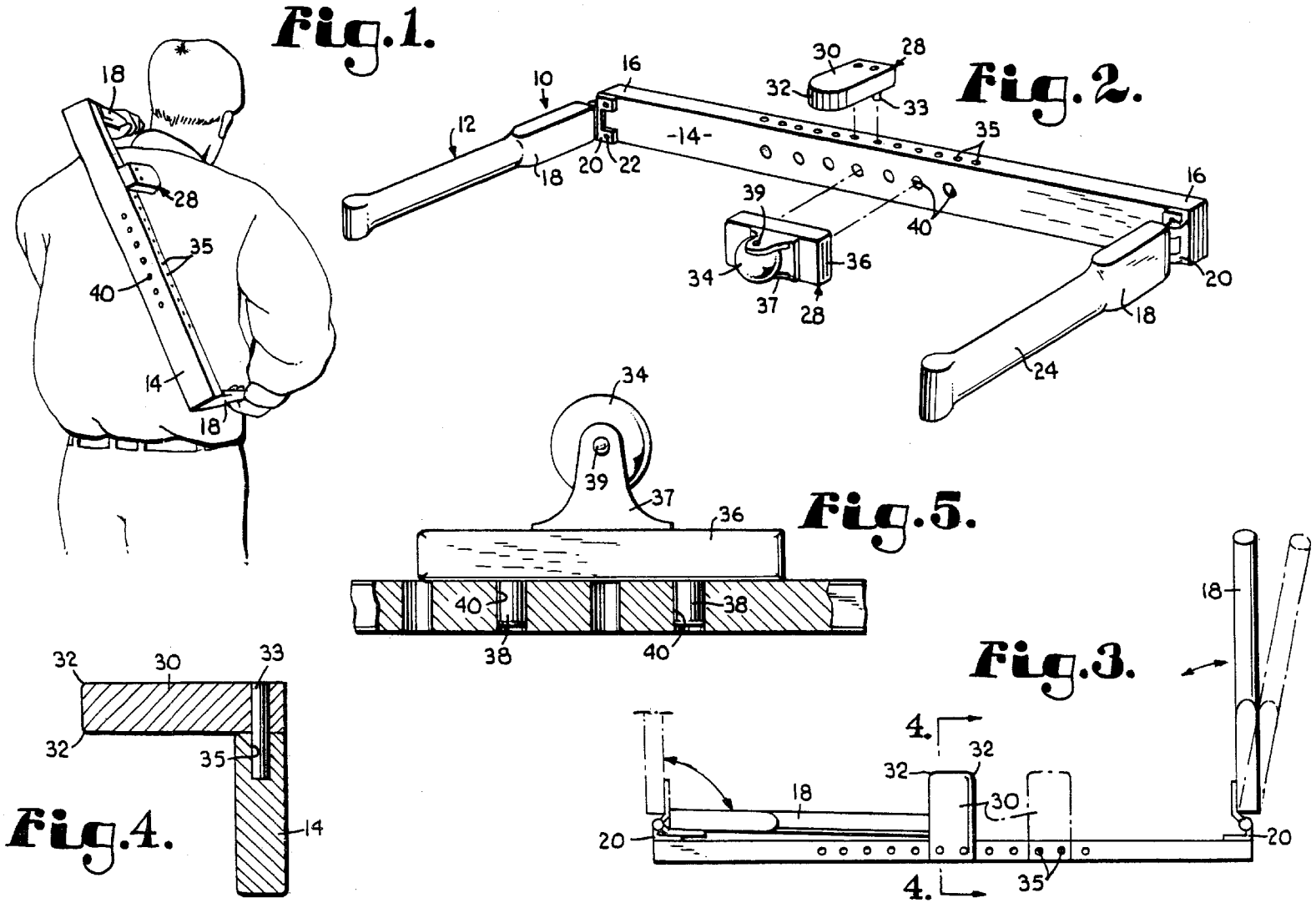
FIG. 1 is a perspective view of the device of the current invention being used by a person.
FIG. 2 is a front perspective view of the device of FIG. 1 with parts exploded away to show particular methods of attachment.
FIG. 3 is a top plan view of the device of FIG. 1, shown with one handle folded inwardly, and with the protrusion shown in an alternative location in phantom lines.
FIG. 4 is a cross-sectional view taken along line 4—4 of FIG. 3.
FIG. 5 is an enlarged partial top plan view showing portions of the device, with parts being broken away to show particular details of construction.

A device embodying the principals of this invention is broadly designated in the drawings by the reference numeral 10. With initial reference to FIG. 2, device 10 includes a generally U-shaped frame 12. U-shaped frame 12 includes an elongated cross-member 14. Cross-member 14 has two terminal ends 16. Coupled to cross-member 14 are a pair of handles 18. Handles 18 extend perpendicularly outward from cross-member 14, and are attached to cross-member 14 at terminal ends 16. Handles 18 are approximately one-half as long as cross-member 14. Handles 18 are preferably hingedly connected to cross-member 14 by a pair of hinges 20. Hinges 20 are secured to cross-member 14 and handles 18 by screws 22. Handles 18 may have a grasping section 24. Grasping section 24 has rounded edges to enhance the comfort of the user, as will be more fully discussed below.

Also extending outwardly from cross-member 14 is a protrusion 28. Protrusion 28 extends outwardly from cross-member 14 in the same direction as handles 18. Preferably, protrusion 28 is centrally disposed between handles 18 on cross-member 14. Protrusion 28, in one embodiment, is a rectangular block 30. Block 30 preferably has forward radiused edges 32. Edges 32 enhance the comfort of the user when the device is used, as is more fully discussed below. Rectangular block 30 is rigidly affixed to cross-member 14 by a pair of dowel pins 33. As can best be seen in FIGS. 2 and 4, dowel pins 33 are inserted into positioning holes 35 on cross-member 14. An adhesive can be applied between block 30 and cross-member 14 to further hold block 30 in place. Preferably, however, block 30 is positionable in a variety of locations along the longitudinal axis of cross-member 14 between handles 18. A number of positioning holes 35 are formed in cross-member 14 for this purpose. If the user of device 10 desires block 30 to be in a different position, dowel pins 33 are removed from positioning holes 35. Block 30 is thereafter repositioned along cross-member 14 and dowel pins 33 are reinserted into a new set of positioning holes 35. In this embodiment, an adhesive is not used to further secure block 30 to cross-member 14.

In an alternative embodiment, as best seen in FIGS. 2 and 5, protrusion 28 is a roller 34. Roller 34 is rotatably held on a support 37 by an axle 39. Roller 34 is preferably coupled to cross-member 14 so that axle 39 is perpendicular to the longitudinal axis of cross-member 14. Support 37 is rigidly secured to a mounting block 36. Extending from mounting block 36 on the side opposite roller 34 are a pair of dowel pins 38. Dowel pins 38 are inserted into a pair of corresponding cylindrical holes 40 on cross-member 14. A series of cylindrical holes 40 are located along cross-member 14 so that roller 34 can be positioned along the longitudinal axis of cross-member 14. If the user of device 10 desires roller 34 to be in a different position along cross-member 14, the user simply removes pins 38 from holes 40 and repositions block 36 on cross-member 14 by inserting pins 38 into a different set of holes 40.

When device 10 is not being used, handles 18 are folded inwardly so that they lie flat against cross-member 14, as best seen in FIG. 3. Prior to folding handles 18 inwardly, block 36 is removed from cross-member 14. For storage, block 36 may be positioned on the side of cross-member 14 that is opposite handles 18. Dowel pins 38 are repositioned in holes 40 to hold block 36 and roller 34 in this storage position.

If it is desired that only rectangular block 30 be used, roller 34 and its mounting block 36 may be completely removed from cross-member 14. Alternatively, when it is desired to use only roller 34, it is not necessary to remove rectangular block 30 from cross-member 14. Roller 34 extends slightly beyond block 30. Therefore, block 30 may remain in place on cross-member 14 even when only roller 34 is going to be used.

Device 10 may be used to treat ailments suffered by a person due to the person having legs of differing lengths. When a person's legs are of different lengths, the person can experience hip pain, lower back pain, and other types of muscular pain. These pains can be alleviated by making adjustments to the body to re-establish even leg length. Device 10 can be used by a person to self-administer such a treatment. Initially, the person determines whether one of his or her legs is longer than the other. This can be done by a visual inspection when the person is seated on the floor, with the person's legs extending directly in front of the person. In this use, the person then rests on his or her back on a flat surface with his or her legs bent so that the person's knee is above the surface. The person then positions device 10 under his or her legs so that protrusion 28 is proximate the area of the ischium bone of the leg which is determined to be longer. The ischium bone is one of the three sections of bone which forms the pelvis and is the bone that bears the weight of a seated person. In this position, the handles 18 extend along the side of the person's body so that they are easily grasped by the person. The person then moves device 10 toward his or her upper body, using handles 18, so that protrusion 28 exerts a force on the targeted ischium bone. Typically, this force is exerted in a quick, thrusting motion. In this manner, a person can self-administer a treatment for varying leg length whenever such a treatment is needed.

Device 10 may also be used to alleviate a person's muscular pain, tightness or discomfort. Device 10 is used by first locating the body part to be treated. The person needing treatment holds device 10 about grasping section 24 on handles 18, as best shown in FIG. 1. Grasping section 24 has rounded edges to provide a more comfortable grip. Using handles 18, the person positions protrusion 28 on the body part needing treatment. The person can then use handles 18 to apply pressure to the body part through protrusion 28. Additional pressure may be applied on the body part by utilizing cross-member 14 and handles 18 as levers. Thus, by using cross-member 14 and handles 18 as levers, the person can exert more force on the body part being treated than would be possible if device 10 were not being used. Radiused edges 32 on block 30 prevent any sharp edges from contacting the user, and thereby allow a greater pressure to be comfortably applied to the body part. Further, due to the configuration of device 10, any body part needing treatment can be reached. It may be necessary to reposition protrusion 28 along the longitudinal axis of cross-member 14 to better treat difficult to reach body parts.

When block 30 is being used as the protrusion, after pressure has been applied to the body part, the user can reposition block 30 a slight distance away from the original position and reapply pressure at this point. Thus, the user may apply pressure at discrete points along a desired path by using block 30. Block 30 is used in this manner to pinpoint specific body parts needing treatment, and to apply isolated pressure to that body part.

Alternatively, if roller 34 is being used, continuous pressure is applied. In other words, once the initial pressure is applied, it is continued. Rather than releasing the pressure applied to the body part and then repositioning the protrusion and reapplying pressure, the user simply moves the roller along the body part needing treatment. Constant and continuous pressure is applied as roller 34 is moved along the body part. Again, handles 18 and cross-member 14 can be used as levers to apply a greater amount of force to the desired area. Therefore, the use of roller 34 rather than block 30 allows the pressure to be applied in a continuous fashion along a greater length of the body. However, use of roller 34 allows the user less control over the area being treated than is capable when block 30 is being used. Device 10 therefore allows a user to select between a deep rolling treatment with continuous pressure and a treatment of discrete applications of pressure at specific points needing treatment.

Device 10 can thus be used to provide a self-administered treatment to any area of the body. Because the use of device 10 does not require another person's services, device 10 can conveniently be used whenever the user desires. Further, through the use of handles 18 and cross-member 14, the user can impart a significantly greater amount of pressure to the treatment area than would be possible without device 10.

From the foregoing, it will be seen that this invention is one well adapted to attain all of the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A device for providing deep muscular manipulation and massage, the device comprising:

a generally U-shaped frame including an elongated cross-member having a given length, a pair of terminal ends and a pair of handles extending perpendicularly outward from said cross-member, one of said handles extending from and pivotally coupled to each of said terminal ends, said handles extending having a given thickness and no more than one half of the length of said cross-member so that said handles may be folded inwardly to lie flat against said cross-member; and a protrusion disposed on said cross-member between said handles, said protrusion extending a distance greater than said thickness of said handles and extending outwardly from said cross-member in the same direction as said handles;

wherein the device may be used to self-administer deep muscular manipulation by exerting a force through said protrusion, with said handles and said cross-member acting to increase the amount of force applied through lever action.

2. The device of claim 1, wherein said protrusion is centrally disposed on said cross-member.

3. The device of claim 2, wherein said protrusion is a fixed rectangular block.

4. The device of claim 2, wherein said cross-member has a longitudinal axis and said protrusion is a roller, and wherein said roller is oriented to rotate about an axis that is perpendicular to said longitudinal axis of said cross-member.

5. The device of claim 1, wherein said protrusion is movable along said cross-member between said handles.

6. A device for treating varying leg lengths by impacting the ischium bone through existing muscle and fat tissue of a person, the device comprising:

an elongated cross-member having a given length, a longitudinal axis, at least one mounting surface, and a pair of terminal ends;

a pair of handles having a given thickness and pivotally coupled to said cross-member so that said handles may be folded inwardly to lie flat against said cross-member and capable of extending perpendicularly outward from said cross-member, wherein one of said handles extends from each of said terminal ends; and a protrusion disposed on said at least one mounting surface and extending a distance greater than said thickness of said handles and extending outwardly a distance from said cross-member in the same direction as said handles such that a force may be applied to the ischium bone of a person through the muscle and fat tissue;

wherein said handles extend outwardly beyond said protrusion.

7. The device of claim 6, wherein said protrusion is centrally disposed on said cross-member.

8. The device of claim 6, wherein said protrusion is movable along said longitudinal axis of said cross-member between said handles.

9. The device of claim 8, wherein said protrusion is a rectangular block.

10. The device of claim 8, wherein said protrusion is a roller, and wherein said roller is oriented to rotate about an axis that is perpendicular to said longitudinal axis of said cross-member.

* * * * *